US005453823A

United States Patent [19]

Hashizume et al.

[11] Patent Number: 5,453,823

[45] **Date of Patent: * Sep. 26, 1995**

[54] IMAGE FORMING APPARATUS EMPLOYING NON-CONTACT BIAS ROLLER TRANSFER

[75] Inventors: Masahiro Hashizume; Susumu Taniguchi; Hiroshi Ishida, all of Osaka, Japan

[73] Assignee: Mita Industrial Co., Ltd., Osaka, Japan

[ * ] Notice: The portion of the term of this patent subsequent to Aug. 9, 2011 has been disclaimed.

[21] Appl. No.: 246,288

[22] Filed: May 19, 1994

[30] Foreign Application Priority Data

May 26, 1993 [JP] Japan ..... 5-124291

[51] Int. Cl.[6] ..... G03G 15/14; G03G 21/00

[52] U.S. Cl. ..... 355/271; 355/309

[58] Field of Search ..... 355/271, 273, 355/276, 272, 309

[56] References Cited

U.S. PATENT DOCUMENTS 4,338,017 7/1982 Nishikawa .
4,464,042 8/1984 Omori et al. .
4,478,506 10/1984 Miyoshi et al. .
4,809,033 2/1989 Ikemoto et al. .
5,138,396 8/1992 Satou et al. ..... 355/308
5,317,371 5/1994 Monma et al. ..... 355/274
5,337,128 8/1994 Hashizume et al. ..... 355/271

*Primary Examiner*—R. L. Moses
*Attorney, Agent, or Firm*—Beveridge, DeGrandi, Weilacher & Young

[57] ABSTRACT

In an image forming apparatus where a transfer roller is arranged to be out of contact with a photoreceptor drum, a guide member for guiding a transfer sheet so as to abut the photoreceptor drum at a predetermined angle and an auxiliary guide member for supporting the transfer sheet to prevent the rear end of the transfer sheet separated from the end of the guide member from being weighed down are arranged close to the photoreceptor drum. Further, to supply a conveying force to the transfer sheet until the rear end of the transfer sheet is separated from the guide member, a conveying roller is arranged opposite to the upper surface of the guide member where the transfer sheet passes.

5 Claims, 9 Drawing Sheets

IMAGE FORMING APPARATUS EMPLOYING NON-CONTACT BIAS ROLLER TRANSFER

BACKGROUND OF THE INVENTION

1. Field of the Invention

The present invention relates to an image forming apparatus such as an electrographic copying machine, a printer and a facsimile machine, and more particularly, to an image forming apparatus in which the precision of transfer of toner images formed on the surface of an electrostatic latent image carrier is improved.

2. Description of the Prior Art

As an image forming apparatus of the above-mentioned type, an apparatus is widely known which is provided with a transfer section employing a contact-type bias roller transfer method using a conductive roller. In the transfer section according to this method, as schematically shown in FIG. 1, in a transfer area of a photoreceptor drum (electrostatic latent image carrier) 31 where a transfer sheet S on which toner images are to be transferred passes, a transfer roller 32 serving as a charge supplying means is arranged to be always in contact with the drum 31 while rotating in a direction corresponding to the direction of rotation of the drum 31, and a transfer voltage of a polarity reverse to that of the toner is applied to the axial core of the transfer roller 32. Reference numeral 33 represents a power source for the voltage application to the axial core of the roller 32.

In the conventional transfer section of the above-described arrangement, the transfer sheet S passing between the surfaces of the transfer roller 32 and the drum 31 is pressed against the toner adhering to the drum surface, and the toner image formed on the drum surface is transferred onto the transfer sheet S by applying the transfer voltage of a polarity reverse to that of the toner to the axial core of the roller 32.

In the transfer section employing the bias roller transfer method, however, since the surface of the drum 31 and the surface of the transfer roller 32 are pressed against each other with the transfer sheet S therebetween, it is apt to occur that the toner located in a central portion of the drum surface is not transferred onto the transfer sheet S and that toner scatters and adheres to peripheral portions of the image transferred onto the transfer sheet S.

To solve such problems of the bias roller transfer method, the present applicant proposed an arrangement as schematically shown in FIG. 2 in Japanese Patent Application H4-284120. In this art a transfer roller 42 is arranged so that a gap larger than the thickness of the transfer sheet S is left between a drum 41 and the roller 42 in order that the surface of the roller 42 is always out of contact with the drum surface, and the transfer sheet S brought in close contact with the drum surface is kept out of contact with the transfer roller 42 to prevent the above-mentioned problems.

In the case of this prior art, it is considered that the reason why the toner images on the surface of the drum 41 are satisfactorily and excellently transferred onto the transfer sheet S although the transfer roller 42 is out of contact with the surface of the drum 41 is that a slight corona discharge is generated from the transfer roller 42 to the reverse surface of the transfer sheet S since a transfer voltage of a polarity reverse to that of the toner is applied from a power source 43 to the transfer roller 42. Actually, excellent test results have been obtained with respect to the performance of toner image transfer.

However, since the transfer roller 42 is arranged to be out of contact with the drum surface and the transfer sheet S is not supported from the reverse side by the transfer roller 42, the movement of the transfer sheet S is unstable, and the contact pressure between the transfer sheet S and the surface of the drum 41 is not kept constant. As a result, there is unevenness in the transferred image.

In the above prior art, a resist roller pair 41 sends out the transfer sheet S at a speed equal to the peripheral speed of the drum. The transfer sheet S is guided along the upper surface of a lower guide member 45 toward the drum 41 while being prevented by an upper guide member 46 from being separated from the upper surface of the lower guide member 45.

The transfer sheet S adheres to the surface of the drum 41 due to electrostatic force after its front end passes the end of the lower guide member 45 and abuts the surface of the drum 41, and moves at a speed equal to the peripheral speed of the drum 41. While the transfer sheet S is in close contact with the surface of the drum 41, a transfer voltage is applied to the transfer roller 42 in order to transfer the toner image from the surface of the drum 41 to the transfer sheet S.

The transfer sheet S which has been separated from the surface of the drum 41 moves along the sheet conveying path towards the downstream side while being weighed down by its own dead load, although it depends on its length. The transfer sheet S is released from the resist roller pair 44 after it reaches the upper surface of a guide table 47, and is conveyed along the guide table 47 to a fixing roller pair (not shown) in accordance with the rotation of the drum 41. As described above, the transfer sheet S bends in a direction opposite to the curve of the drum surface between the lower guide member 45 and the guide table 47. The resiliency of the transfer sheet S generated by the bend works as the contact pressure on the portion of the transfer sheet S which is in contact with the surface of the drum 41.

The conveying speed of the transfer sheet S and the angle of inclination of the upper surface of the lower guide member 45 which guides the transfer sheet S toward the drum 41 are set so that conditions are fulfilled for making the transfer sheet S to be in close contact with the surface of the drum 41 while being conveyed at a speed equal to the peripheral speed of the drum surface. In actuality, however, the resiliency of the transfer sheet S varies according to environmental conditions such as the temperature and humidity around the transfer area.

For this reason, under an environmental condition where the above setting conditions are not fulfilled, the transfer sheet S may not be in contact with the drum surface at a predetermined contact pressure since the transfer sheet S is not sufficiently resilient. Moreover, since some accumulative errors are caused in the sheet feeding speed of feeding roller pairs provided at a plurality of positions in a paper feeding mechanism (not shown) arranged on the upstream side of the transfer section, it is unavoidable that the position of the transfer sheet S deviates relative to the position of the toner image on the surface of the drum 41.

Such error factors relating to paper feeding cause no problems in the case of the conventional contact-type transfer roller 32 shown in FIG. 1, since the roller 32 rotates synchronously with the drum 31 to restrict the conveying speed of the transfer sheet S. However, when the transfer roller 42 is out of contact with the drum 41 like in the prior art of FIG. 2, it is difficult to eliminate the generation of unevenness in the transferred image since no means is provided for forcibly regulating the conveying speed and the transfer timing of the transfer sheet S.

The sheet which has been separated from the drum 41 is pulled by the fixing roller pair. Since the peripheral speed slightly differs between the fixing roller pair and the resist roller pair 44, the transfer sheet S may excessively be pulled by the fixing roller pair or may be bent between the drum 41 and the fixing roller pair. However, regarding this, normally, the diameter of the rollers constituting the resist roller pair 44 and the fixing roller pair are each set so that the transfer sheet S is slightly bent between the roller pairs.

When the transfer sheet S is short, the rear end thereof may be separated from the resist roller pair 44 while transfer is still being performed. For such a case, a fact is utilized that the transfer sheet S is attracted to the drum surface by electrostatic force. The rollers and guide members are so arranged that the attractive force keeps the transfer sheet S free from position shift or disorder all the way to the fixing roller pair.

In the arrangement of the above prior art, the movement speed of the transfer sheet S and the peripheral speed of the drum surface are maintained coincident with each other while the resist rollers 44 is nipping the transfer sheet S as shown in FIG. 2. However, after the rear end of the transfer sheet S is released from the resist roller pair 44, the movement speed of the transfer sheet S slightly changes since the transfer sheet S comes into close contact with the upper guide member 46 due to its resiliency as shown in FIG. 3. As a result, in the rear end portion of the transfer sheet S, the latent image formed on the drum surface is transferred with its position slightly shifted.

Further, as shown in FIG. 4, after the rear end of the transfer sheet S leaves the end of the lower guide member 45, a downward force due to the dead load works on the rear end portion of the transfer sheet S. Therefore, the contact pressure between the transfer sheet S and the surface of the drum 41 is reduced largely, though the foregoing portion of the transfer sheet S still adheres to the surface of the drum 41 by the electrostatic force. Because of this, the toner image is not transferred correctly in the rear end portion of the transfer sheet S.

Thus, when a high definition image is required, it is difficult in the above prior art to realize a sufficient transfer precision only by setting the arrangement of the rollers and guide members accurately or varying the positions of the guide members.

SUMMARY OF THE INVENTION

The present invention is for settling the above-mentioned problems encountered in an image forming apparatus where the electrostatic image carrier and the charge supplying means are arranged out of contact.

A first object of the present invention is to guide a transfer sheet to a transfer area on the surface of the image carrier so that the sheet keeps in contact with the surface of the image carrier at a correct and sufficient contact pressure.

A second object of the present invention is to prevent a deterioration of transfer quality especially in the rear portion of the transfer sheet by actively conveying the sheet in the vicinity of the surface of the image carrier.

To achieve the first object, according to the present invention, in an image forming apparatus having a photoreceptor drum as the electrostatic latent image carrier and a transfer roller as the charge supplying means which are disposed separate with a gap larger than the thickness of a transfer sheet therebetween, a guide member and an auxiliary guide member are arranged on a conveying path for supplying a transfer sheet to a transfer area. The transfer sheet is guided to abut the photoreceptor drum at a predetermined angle by the guide member. The auxiliary guide member is arranged at a position to support the sheet in order for the rear end portion thereof to keep the correct conveying path without dangling after the sheet is separated from the guide member. To achieve the second object, in addition to the above-described features, a conveying roller is arranged opposite to the guide member, to supply a conveying force to the transfer sheet until its rear end is separated from the guide member. The conveying roller is arranged in the vicinity of the end of the guide member which is close to the photoreceptor drum, in contact or out of contact with the guide member.

BRIEF DESCRIPTION OF THE DRAWINGS

These and other objects and features of this invention will become clear from the following description, taken in conjunction with the preferred embodiments with reference to the accompanied drawings in which.

DESCRIPTION OF THE PREFERRED EMBODIMENTS

Figure 1:
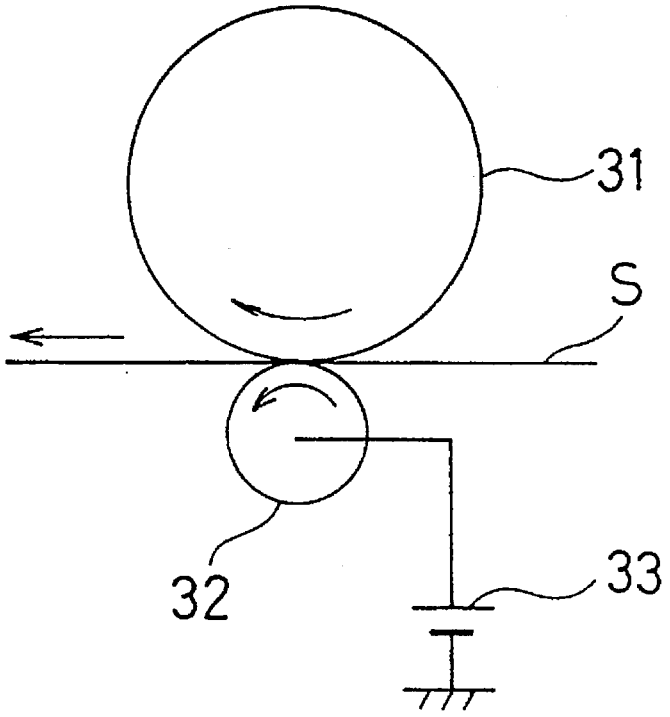
Fig. 1 Prior Art
FIG. 1 is a front view schematically showing a conventional art employing the bias roller transfer method.
Figure 2:
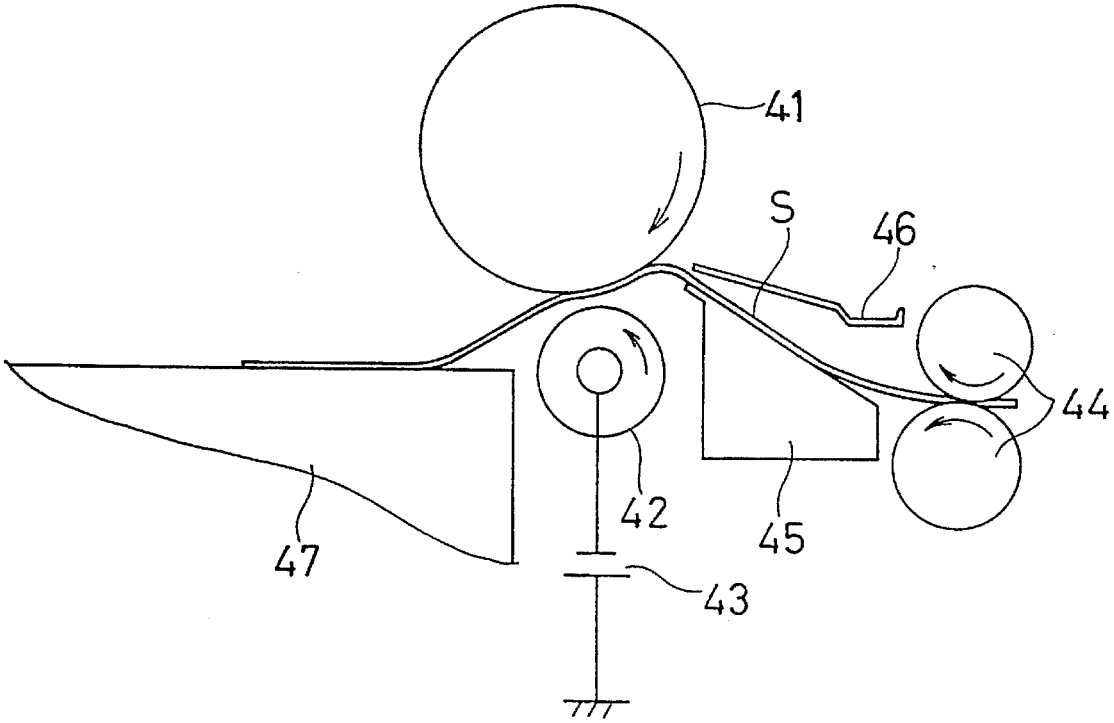
Fig. 2 Prior Art
FIG. 2 is a front view schematically showing a relevant portion of an image forming apparatus according to a prior art.
Figure 3:
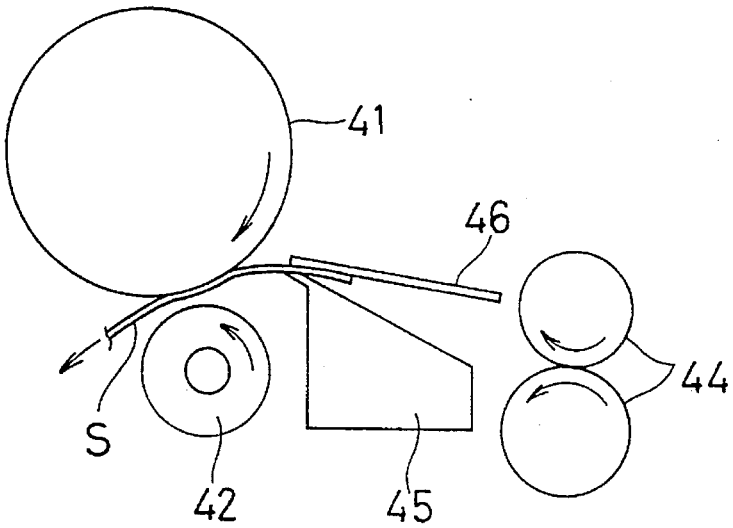
Fig. 3 Prior Art
FIG. 3 is a front view of the relevant portion schematically showing an undesirable operation condition in the prior art.
Figure 4:
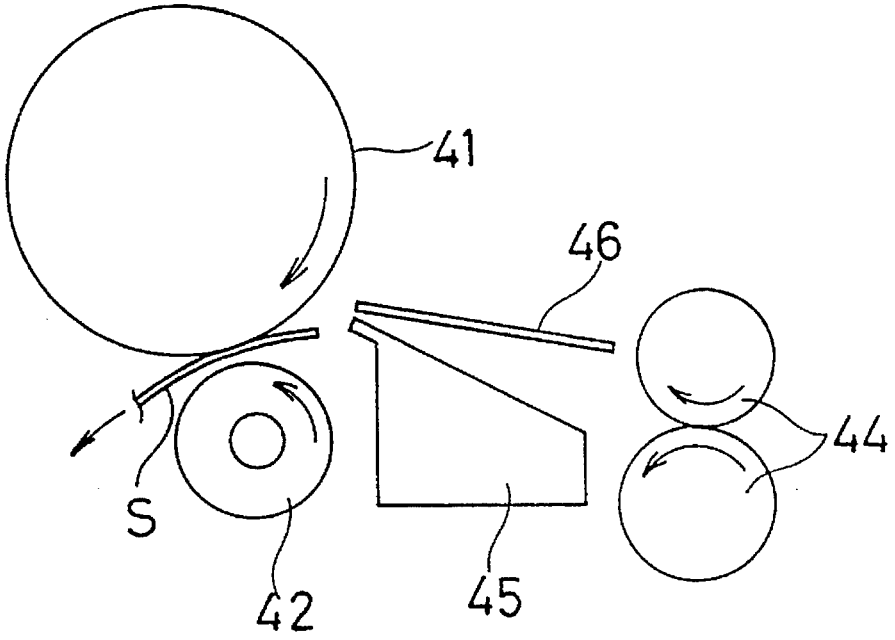
Fig. 4 Prior Art
FIG. 4 is a front view of the relevant portion schematically showing another undesirable operation condition in the prior art.
Figure 5:
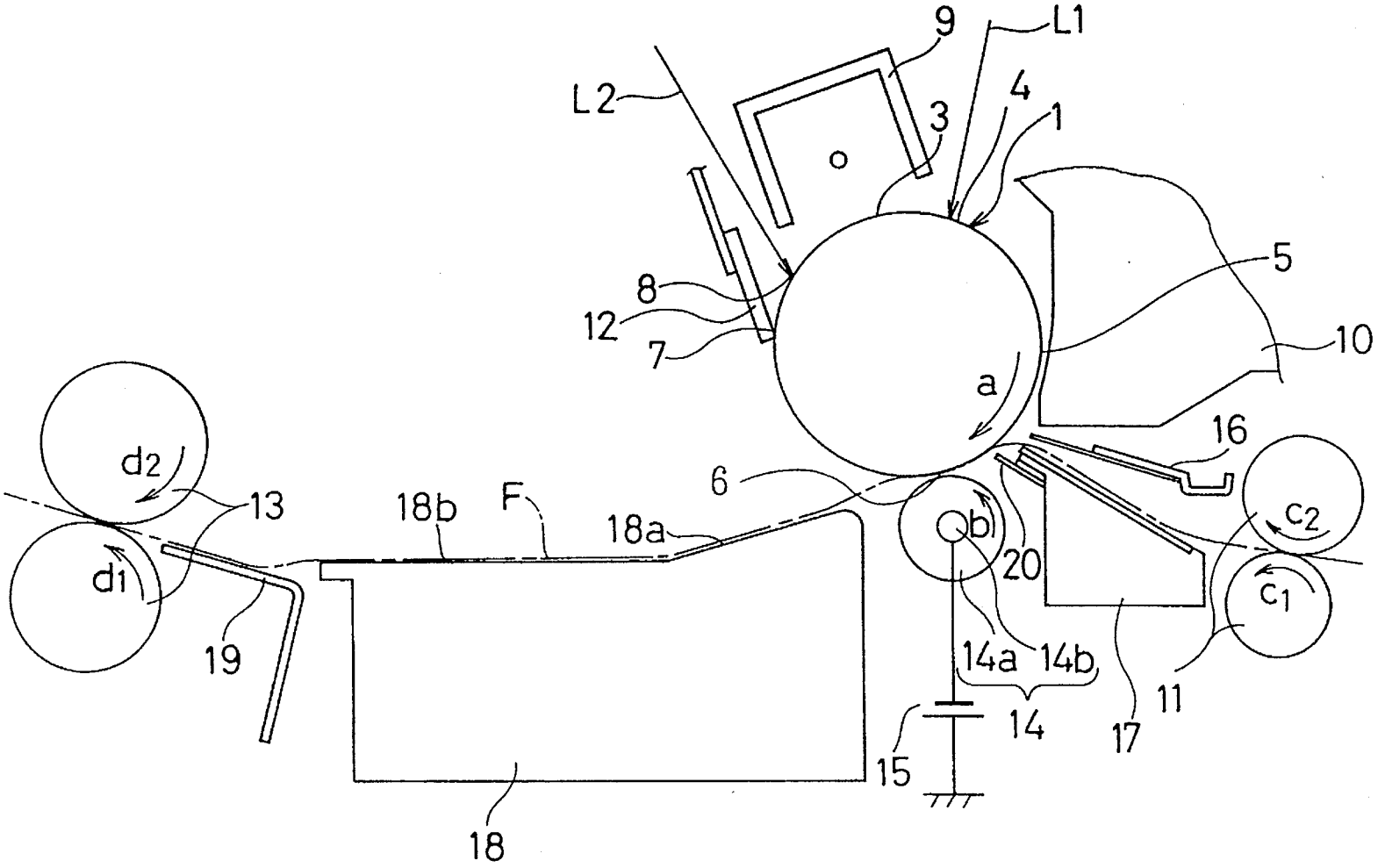
FIG. 5 is a front view schematically showing a relevant portion of a first embodiment of the present invention.
Figure 6:
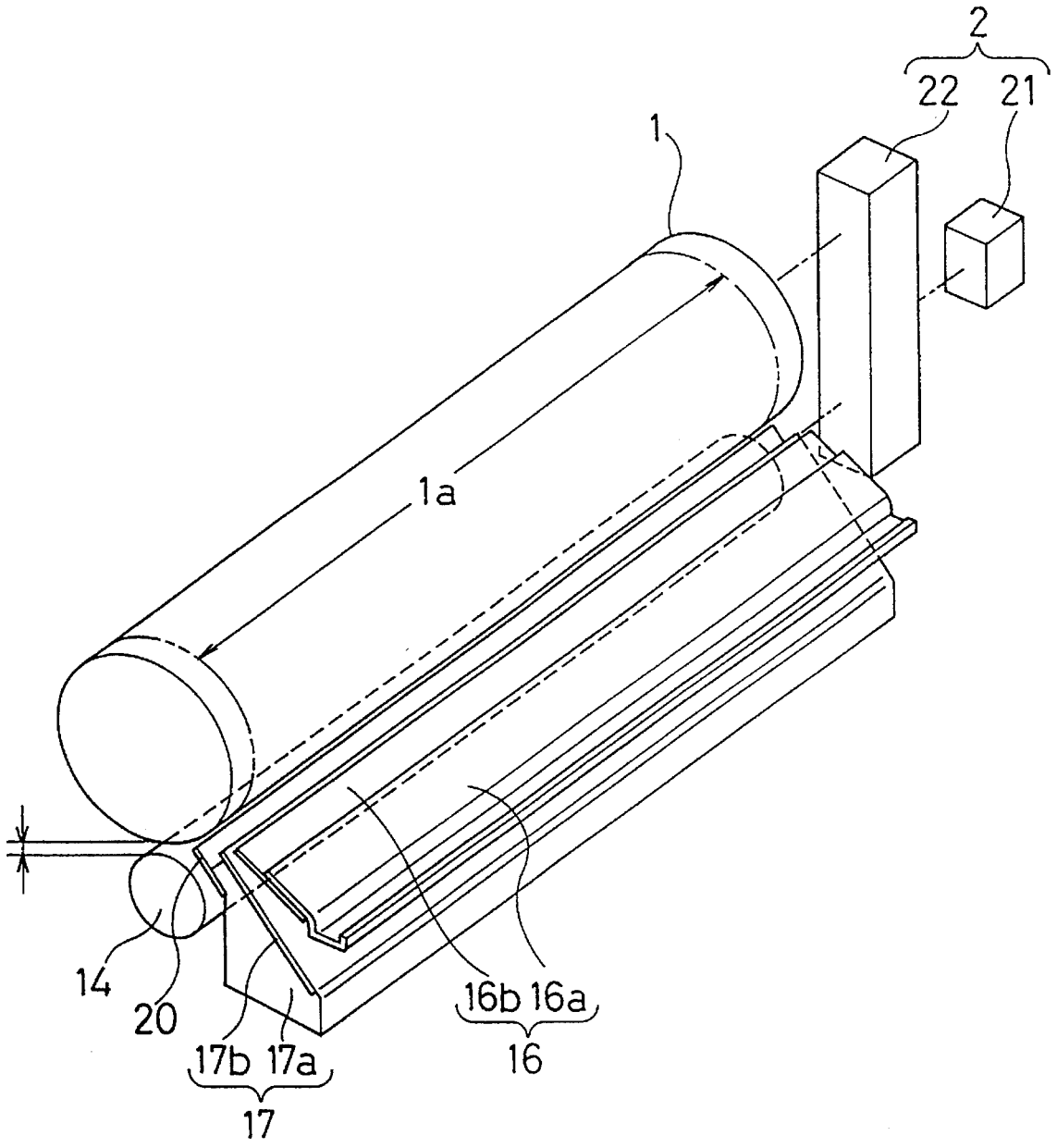
FIG. 6 is an enlarged perspective view schematically showing an arrangement of a transfer section of the first embodiment of the present invention.
Figure 7:
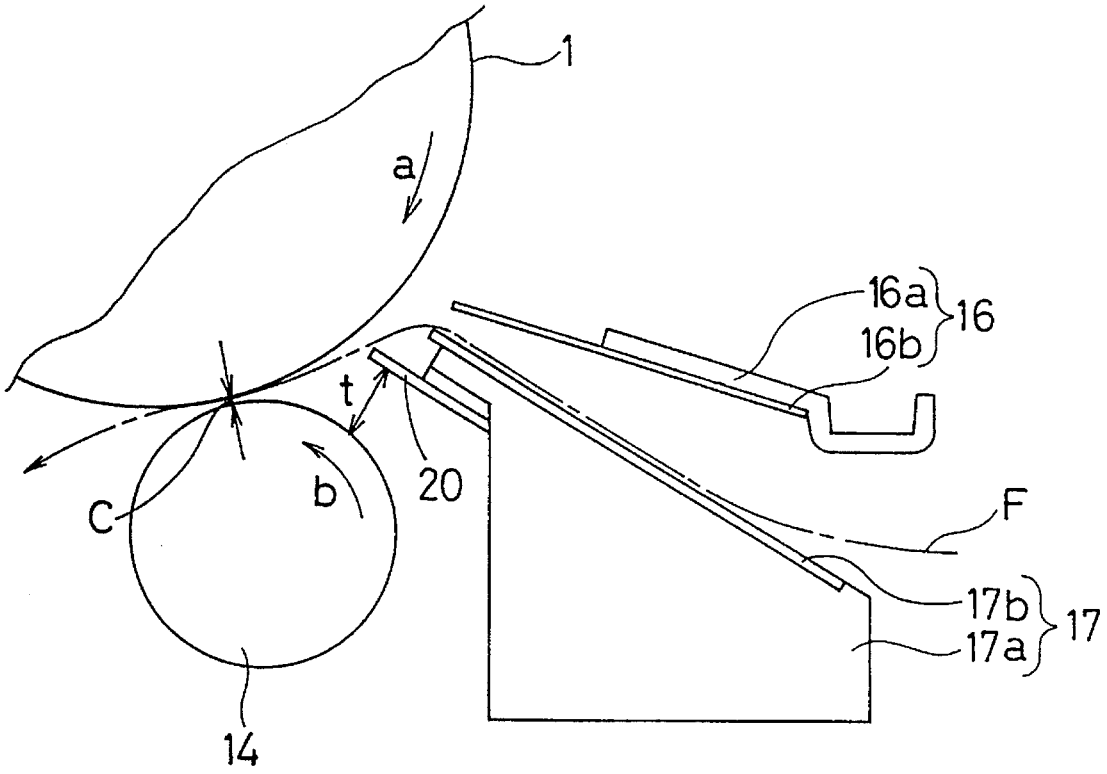
FIG. 7 is an enlarged front view of the transfer section of the first embodiment of the present invention.

FIGS. 5 to 8 shows a first embodiment where the present invention is employed in an electrographic copying machine. FIG. 5 shows a relevant portion of the copying machine, and FIGS. 6 and 7 schematically show a transfer section of the copying machine. In FIGS. 5 to 7, reference numeral 1 represents a photoreceptor drum (electrostatic latent image carrier) which comprises a tube made of a metal such as aluminum on which a photosensitive layer made of amorphous silicon (a-Si) or other photosensitive material is formed.

The drum 1 is arranged substantially horizontally in the copying machine, and is rotated clockwise (i.e. in a direction of arrow a) by a driving system 2 provided in the copying machine. The direction of rotation of the drum 1 is set to correspond to the conveying direction of a transfer sheet S in a transfer area mentioned below. On the surface of the drum 1, a charging area 3, an exposure area 4, a development area 5, a transfer area 6, a cleaning area 7 and a charge-removal area 8 are set in this order in the rotation direction of the drum 1.

In the copying machine of the arrangement described above, the photosensitive layer on the surface of the drum 1 is charged by a corona discharger 9 arranged opposite to the drum surface in the charging area 3. To the charged photosensitive layer on the drum surface, a reflected light L1 of an image read out from an original by a non-illustrated optical system provided in the copying machine is irradiated in the exposure area 4 to form an electrostatic latent image.

In the development area 5, charged toner is attached to the electrostatic latent image by a developer unit 10 arranged to front the drum surface to form a toner image. Then, in the transfer area 6, the toner image on the drum 1 is transferred in a manner described later onto the transfer sheet S fed by a resist roller pair 11 along a sheet conveying path F shown by the alternate long and short dash line.

After the transfer, toner remaining on the drum surface is removed by a cleaning blade 12 arranged to be in contact with the drum surface in the cleaning area 7, and in the charge-removal area 8, a charge removing light L2 is irradiated onto the drum to remove the charge. The drum 1 is ready for the next charging when it makes one revolution after the last charging. The transfer sheet S on which the toner image is transferred in the transfer area 6 is sent to a fixing roller 13, and heated and pressurized while it is passing through the fixing roller pair 13 to fix the toner image on the transfer sheet S.

The above-described means for charging, exposure, development, cleaning and charge removal arranged on the periphery of the drum 1 are described as examples of means for these operations and they are not limited thereto. The operations may be performed by other known means instead of the above-described means.

At a position opposite to the transfer area 6 on the lower surface of the drum 1, a transfer roller 14 serving as a charge supplying means is arranged. The transfer roller 14 is arranged below the drum 1 to be parallel to the drum axis at a position close and opposite to the surface of the drum 1 so that a gap C larger than the thickness of the transfer sheet S is left therebetween with the sheet conveying path F between.

During transfer, the transfer roller 14 transfers the charged toner adhering to the surface of the drum 1 to the transfer sheet S in the development area 5 by being provided with a transfer voltage of a polarity reverse to that of the charged toner. The roller 14 is of a long-axis roller form where a roller body 14*a* having a length equal to or greater than the width of a toner image forming area on the surface of the drum 1 is integrally fixed around a rotation axis 14*b*.

The roller body 14*a* of the transfer roller 14 is made of a conductive resin material or a conductive rubber material such as polystyrene resin or urethane resin in which carbon or an alkali metal is mixed. The transfer voltage is applied to the rotation axis 14*a*. A power source 15 for applying the transfer voltage is arranged between the rotation axis 14*a* and ground.

Between the resist roller pair 11 and the drum 1 are arranged upper and lower guide members 16 and 17 so as to oppose each other with the sheet conveying path F between. In the downstream side of the transfer roller 14 along the sheet conveying path F is arranged a guide table 18. Reference numeral 19 represents a sheet guide arranged between the guide table 18 and the fixing roller pair 13.

The lower guide member 17 guides the transfer sheet S fed by the resist roller pair 11 in such direction that the transfer sheet S abuts the surface of the drum 1 at a predetermined admission angle. The upper surface thereof serving as a guide surface is a flat slanting surface rising at a predetermined angle toward the drum 1. More specifically, the lower guide member 17 is made by attaching a sheet member 17*b* made of synthetic resin which serves as the guide surface to a slanting upper surface of a supporting frame 17*a* so that an end of the sheet member 17*b* protrudes slightly farther than an end of the supporting frame 17*a*.

The upper guide member 16 prevents the transfer sheet S from being separated from the lower guide member 17 while the transfer sheet S is being sent along the conveying path F, and when toner drops from the developer unit 10, it prevents the toner from falling onto the transfer sheet S and adhering thereto. The upper guide member 16 is slanted so as to be closer to the lower guide member 17 as it approaches the drum 1. The upper guide member 16 is also made by attaching a sheet member 16*b* made of synthetic resin to the lower surface of a supporting member 16*a* arranged opposite to the lower guide member 17.

The guide table 18 is arranged close to the transfer roller 14, and the upper surface thereof serving as a guide surface is formed so that an upstream side portion 18*a* along the sheet conveying path F gradually slants downward from a position lower than the lower end of the drum 1 toward the downstream side and that a downstream side portion 18*b* ranging from the downstream side end of the slanting surface to the sheet guide 19 is formed to be substantially horizontal.

FIG. 7 is an enlarged view of a relevant portion of the transfer section of the above-described arrangement. As shown in the figure, in this embodiment, an auxiliary guide member 20 for supporting the transfer sheet S from the reverse surface thereof is provided to the supporting frame 17*a* of the lower guide member 17. The auxiliary guide member 20 is arranged between the transfer roller 14 and the end of the sheet member 17*b* serving as the guide surface of the lower guide member 17 on the sheet conveying path F which is determined to be the line along which the transfer sheet S exists when it is in contact with both the end of the sheet member 17*b* and the transfer area of the surface of the drum 1 while the sheet is conveyed.

More specifically, the auxiliary guide member 20 is made of a rectangular sheet which is long from side to side, and is attached to the lower guide member 17 at the end of the supporting frame 17*a* below the sheet member 17*b* so as to be substantially parallel to the sheet member 17*b*. The arrangement of the auxiliary guide member 20 is such that an end thereof protrudes from the end of the sheet member 17*b* toward the downstream side while being lower than the sheet member 17*b* but higher than the transfer area 6 on the drum surface. The distance t between the auxiliary guide member 20 and the surface of the transfer roller 14 is set to approximately 5 mm for a good result.

It is preferable for the auxiliary guide member 20 to have some elasticity. A synthetic resin film such as polypropylene terephthalate film, whose thickness can be set to offer an appropriate elasticity, meets this requirement. The preferable thickness thereof is approximately 125 μm. The thickness of the sheet member 17*b* of the lower guide member 17 is set to approximately 200 μm.

Returning to FIG. 6, the driving system 2 includes a main motor 21 serving as a driving source for each section of the copying machine, and a power transmitting system 22. In FIG. 6, the power transmitting system 22 is schematically shown and no specific arrangement thereof is shown.

In the driving system 2, the driving force of the main motor 21 is transmitted, through the power transmitting system 22 including a gear train, a clutch mechanism and a link mechanism, to each driven portion including the resist roller pair 11, the drum 1 and the transfer roller 14. At the power transmitting system 22, the speed ratio, the driving direction and the driving timing of each driven portion are associated mutually.

Therefore, in this embodiment, in order to convey the transfer sheet S along the conveying path F at a speed equal to the peripheral speed of the drum 1, the resist roller pair 11 is rotated in a direction corresponding to the direction of rotation of the drum 1 at a speed equal to the peripheral speed of the drum 1. The drum 1 is driven at a predetermined timing. In FIG. 5, the arrow b shows the direction of rotation of the transfer roller 14, the arrows $C_1$ and $C_2$ show the rotation directions of the rollers of the resist roller pair 11, and the arrows $d_1$ and $d_2$ show the rotation directions of the rollers of the fixing roller pair 13.

In the image forming apparatus of the arrangement described above, the resist roller pair 11 sends out the transfer sheet S at a speed equal to that of the drum surface synchronously with the rotation of the drum 1, and the transfer sheet S is guided toward the drum 1 along the lower guide member 17. After passing the lower guide member 17, the transfer sheet S is guided, with the reverse surface being supported by the upper surface of the end of the auxiliary guide member 20, to abut the surface of the drum 1, and adheres to the transfer area 6 of the drum 1 due to electrostatic force.

While the transfer sheet S is in contact with the drum surface, a voltage of a polarity reverse to that of the toner image on the drum surface is applied to the transfer roller 14 by the power source 15, and by the Coulomb's force generated thereby, the charged toner adhering to the surface of the drum 1 is transferred onto the transfer sheet S.

The transfer sheet S onto which the image has been transferred is separated from the surface of the drum 1, and after its front end reaches the upper surface of the guide table 18, its rear end is separated from the resist roller pair 11. Then, the transfer sheet S is conveyed along the guide table 18 in accordance with the rotation of the drum 1 and set to the fixing roller pair 13 by way of the sheet guide 19.

Figure 8:
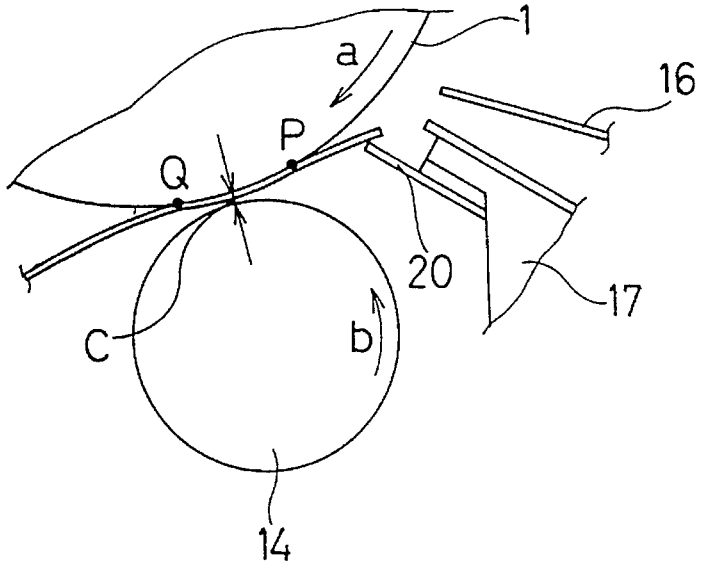
FIG. 8 is a front view of a relevant portion showing the operation of an auxiliary guide member.

In the above-described operation of the transfer section, as shown in FIG. 8, when a start point of the transfer area 6 of the drum 1 which the transfer sheet S separated from the lower guide member 17 abuts first is P and an end point of the transfer area 6 at which the transfer sheet S is separated from the surface of the drum 1 is Q, it is necessary for the transfer sheet S to be in close contact with the surface of the drum 1 at an appropriate constant contact pressure between the start point P and the end point Q in the transfer area 6.

In this case, when the transfer sheet S is conveyed along the lower guide member 17 and the transfer area 6 on the surface of the drum 1, the transfer sheet S is in contact with the surface of the drum 1 substantially in an appropriate condition while the conveying force is supplied by the resist roller pair 11. However, when the rear end of the transfer sheet S is released from the end of the lower guide member 17, if the auxiliary guide member 20 is not provided, the rear end portion of the transfer sheet S is weighed down by its own dead load and deviates from the sheet conveying path F. As a result, the necessary contact pressure is not obtained in the vicinity of the start point P in the transfer area 6.

In this embodiment, since the auxiliary guide member 20 is provided as shown in FIG. 8 along the sheet conveying path F between the end of the lower guide member 17 and the start point P in the transfer area 6 on the surface of the drum 1, the rear end of the transfer sheet S is supported from the reverse side by the auxiliary guide member 20 just before it is brought into contact with the drum surface, and is sent into the transfer area 6 by way of the sheet conveying path F without deviating from the path F. As a result, the contact pressure working on the transfer sheet S in the transfer area 6 on the surface of the drum 1 is maintained substantially constant as far as the rear end of the transfer sheet S, thereby preventing inferior transfer.

Therefore, the auxiliary guide member 20 in the transfer section is arranged so that the end thereof is located at a position where the rear end of the transfer sheet S separated from the end of the lower guide member 17 starts to be weighed down. Moreover, since a load due to the dead load of the transfer sheet S and the conveying force works on the auxiliary guide member 20 when the transfer sheet S passes on the auxiliary guide member 20, the auxiliary guide member 20 is slightly deformed elastically. The elastic resiliency generated in the auxiliary guide member 20 due to the deformation assists the contact of the transfer sheet S with the transfer area 6 on the surface of the drum 1 in cooperation with the resiliency of the transfer sheet S generated by the bend of the transfer sheet S between the lower guide member 17 and the surface of the drum 1. As a result, the contact condition is further improved.

According to the above-mentioned arrangement, even if the resiliency of the transfer sheet S is changed, the transfer sheet S is conveyed along the conveying path F while being in contact with the transfer area 6 on the surface of the drum 1 at a correct and sufficient contact pressure. As a result, the contact pressure of the transfer sheet S in the transfer area 6 on the drum surface is maintained substantially constant as far as the rear end of the transfer sheet S, thereby realizing a high-definition copy image.

Figure 9:
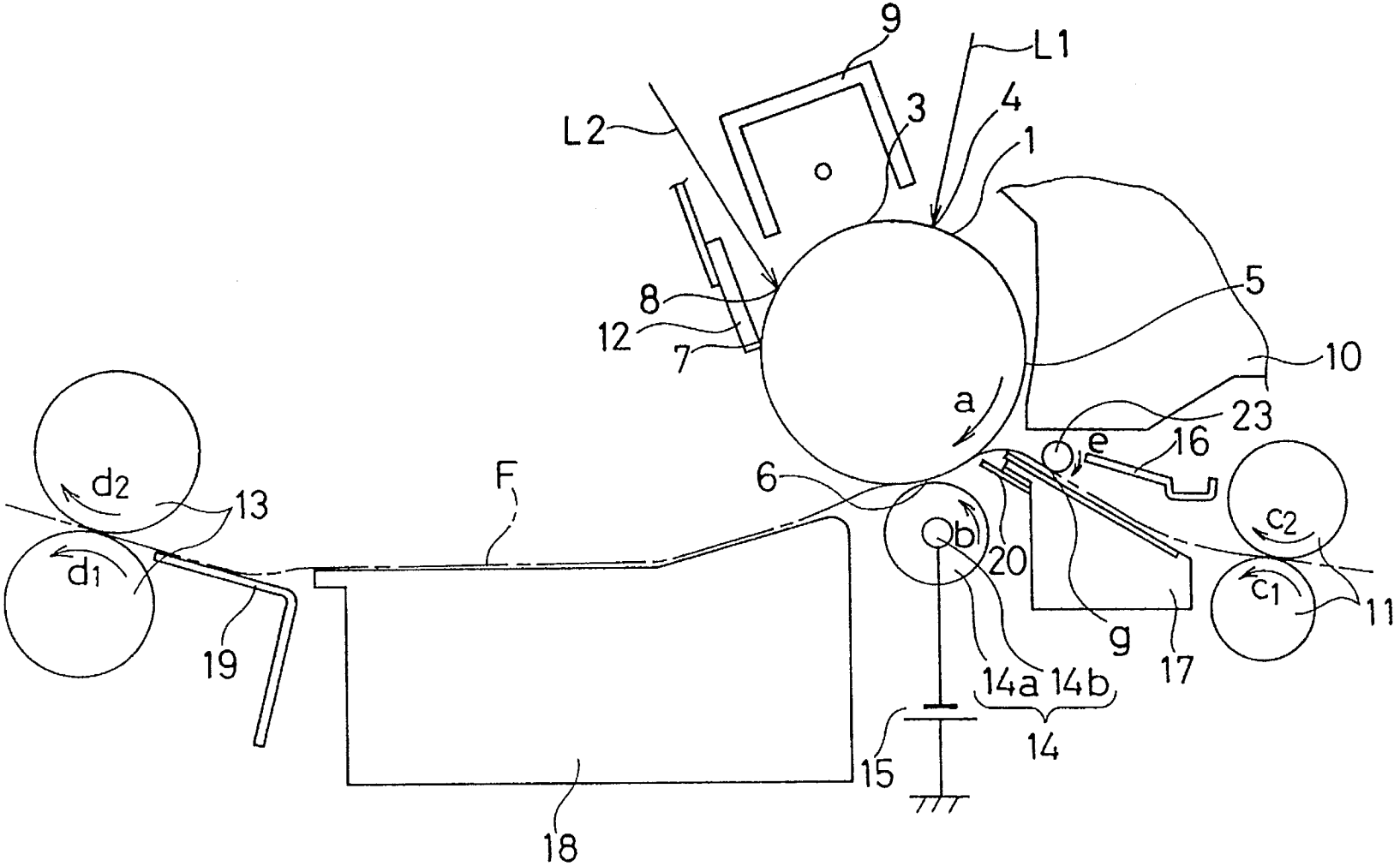
FIG. 9 is a front view schematically showing a relevant portion of a second embodiment of the present invention.
Figure 10:
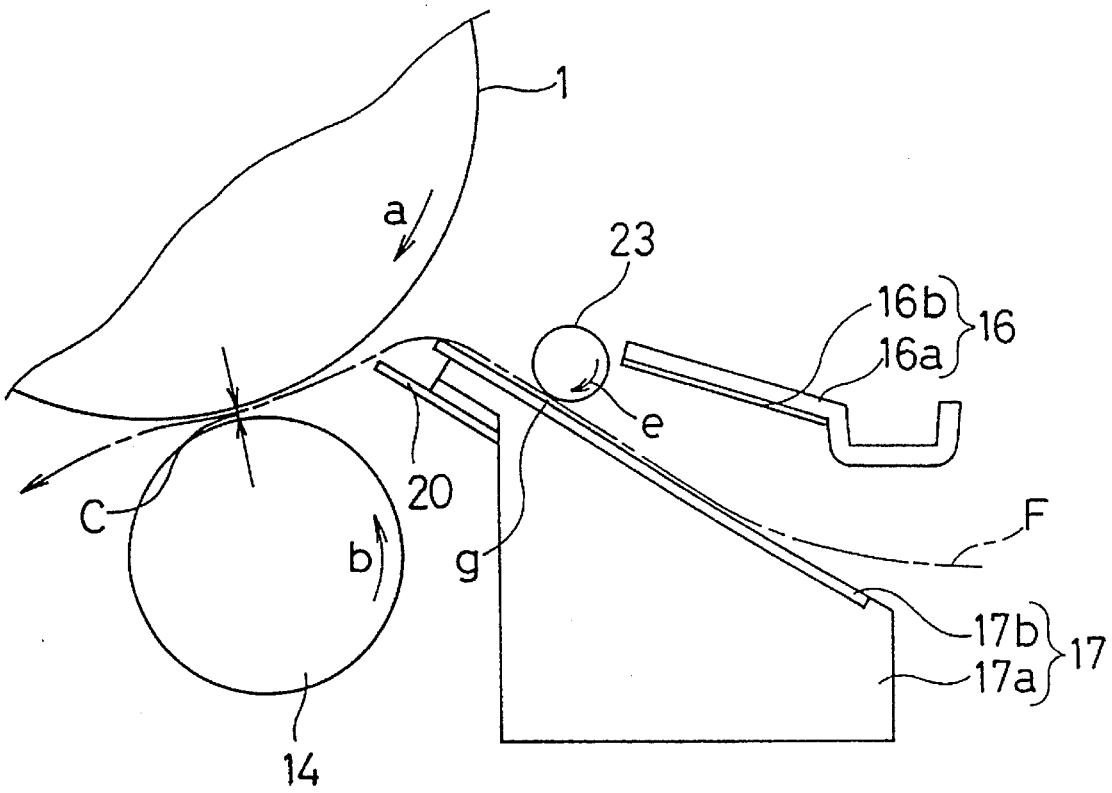
FIG. 10 is an enlarged front view of a transfer section of the second embodiment of the present invention.
Figure 11:
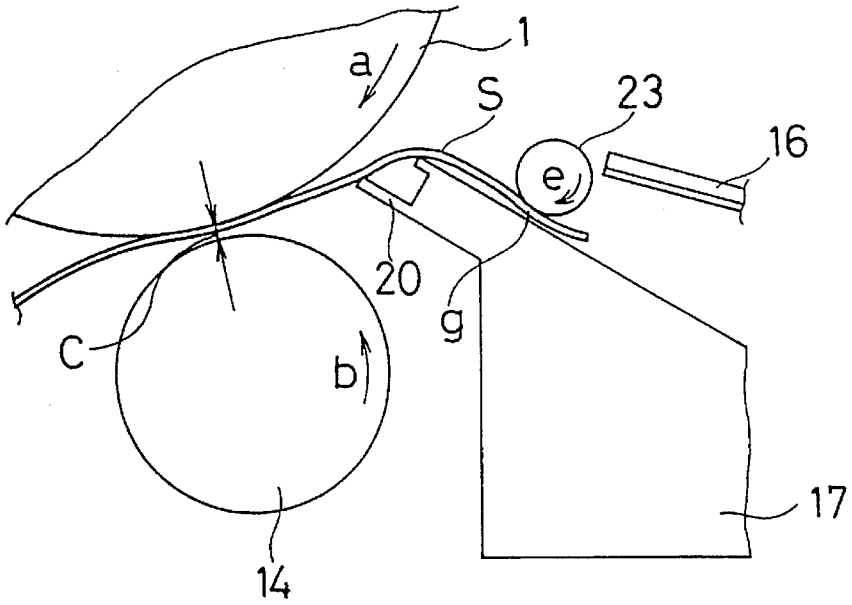
FIG. 11 is a front view of a relevant portion showing the operation of a conveying roller.

FIGS. 9 to 11 show a second embodiment where the present invention is employed in an electrographic copying machine. FIG. 9 schematically shows a relevant portion of the copying machine. FIG. 10 schematically shows a transfer section thereof. In this embodiment, in addition to the above-described features of the first embodiment, a conveying roller 23 rotated at a peripheral speed equal to the movement speed of the surface of the drum 1 is arranged to oppose the vicinity of the end of the upper surface of the lower guide member 17. In this embodiment, the same elements and portions as those of the first embodiment are denoted by the same reference designations and no description thereof will be given.

In this embodiment, the conveying roller 23 is arranged opposite to the flat slanting upper surface of the lower guide member 17 provided on the sheet conveying path F with a predetermined gap g between, and is rotated in a direction the same as the direction of rotation of the drum 1 at a peripheral speed equal to the peripheral speed of the drum 1. While the gap between the upper surface of the lower guide member 17 and the surface of the conveying roller 23 is 0.2 to 1 mm in this embodiment, the size of the gap g is not limited thereto.

The driving system for the conveying roller 23 can be added to the power transmitting system 22 of the driving system 2 of the first embodiment. By this arrangement, the conveying roller 23 is driven in association with the speed ratio, the driving direction and the driving timing of the drum 1 and the resist roller pair 11. In FIG. 9, the arrow e shows the direction of rotation of the conveying roller 23.

The conveying roller 23 is made of a material having a relatively larger friction coefficient, such as conductive silicon rubber. Further, like the transfer roller 14, it is necessary for the conveying roller 23 to be longer than the length, along the drum axis, of the toner image forming area on the drum surface. The conveying roller 23 may be made of one roller as shown in FIG. 6, or it may consist of a plurality of short rollers which can simultaneously be rotated about the same axis.

In order to arrange the conveying roller 23 close to the surface of the drum 1, a shorter roller diameter is more favorable as far as the conveying of the transfer sheet S is not hindered. Further, the present invention includes an arrangement where a plurality of small-diameter needle-shaped conveying rollers are arranged along the sheet conveying path F.

In this arrangement, the transfer sheet S conveyed along the sheet conveying path F by the rotation of the resist roller pair 11 passes between the conveying roller 23 and the lower guide member 17 without being in contact with the roller 23 until its front end reaches the surface of the drum 1. After passing the end of the lower guide member 17 and the auxiliary guide member 20 and abutting the surface of the drum 1, the transfer sheet S adheres to the surface of the drum 1 due to electrostatic force while being bent and deformed, and is conveyed along the transfer area 6 on the drum surface while being in close contact with the drum surface.

At this time, the transfer sheet S receives a reaction force from the drum surface and is bent by its own resiliency between the drum surface and the end of the lower guide member 17, whereby the bent portion of the transfer sheet S is pressed onto the conveying roller 23 so that the conveying roller 23 provides the transfer sheet S with a driving force in the conveying direction.

When the transfer sheet S is conveyed and separated from the resist roller pair 11 as shown in FIG. 11, since the rear end of the transfer sheet S is bent upward due to its own resiliency to come in contact with the conveying roller 23, the conveying force of the conveying roller 23 continues to be transmitted to the transfer sheet S. Since the conveying roller 23 supplements the conveying force of the transfer sheet S after the transfer sheet S is separated from the resist roller pair 11, the transfer sheet S is conveyed substantially in the same condition as when the transfer sheet S is nipped by the resist rollers 11.

As described above, in this embodiment, by setting an appropriate positional relationship among the three positions, that is, the portion on the surface of the drum 1 where the transfer sheet S abuts the drum surface, the end portion of the lower guide member 17 and the position of the conveying roller 23, the transfer sheet S is made capable of bending between the drum surface and the end portion of the lower guide member 17, and by using the resiliency of the transfer sheet S generated thereby, the transfer sheet S is brought into contact with the conveying roller 23 so that it is forcibly conveyed.

By arranging the conveying roller 23 so that a predetermined gap exists between the roller 23 and the upper surface of the lower guide member 17, the auxiliary conveying operation of the transfer sheet S by the conveying roller 23 effectively works, while generation of strange noise and increase in load torque for the conveying roller 23 are completely prevented since the roller 23 is out of contact with the lower guide member 17.

The conveying roller 23 may be arranged to be substantially in contact with the slanting upper surface of the lower guide member 17. In this case, although the roller 23 may be rotated being in contact with the upper surface of the lower guide member 17 when the transfer sheet S is not supplied, the transfer sheet S is conveyed reliably.

After the rear end of the transfer sheet S is separated from the conveying roller 23, the transfer sheet S is not deviated from the conveying path F because of the presence of the auxiliary guide member 20, like in the first embodiment. As a result, transfer is excellently performed as far as the rear end of the transfer sheet S. In the transfer sheet S separated from the conveying roller 23, the length of the rear end portion which is considered to require the support from the reverse side is approximately 7 to 8 mm.

In the above-described arrangement provided with the conveying roller 23, since the change in conveying speed occurring after the transfer sheet S is separated from the resist roller pair 11 is compensated for, slight deviation of images caused in the rear end portion of the transfer sheet S is restrained. Since the transfer sheet S is in contact with the transfer area 6 on the surface of the drum 1 at a necessary and satisfactory contact pressure as far as the rear end of the transfer sheet S, a high-definition copy image is obtained.

Figure 12:
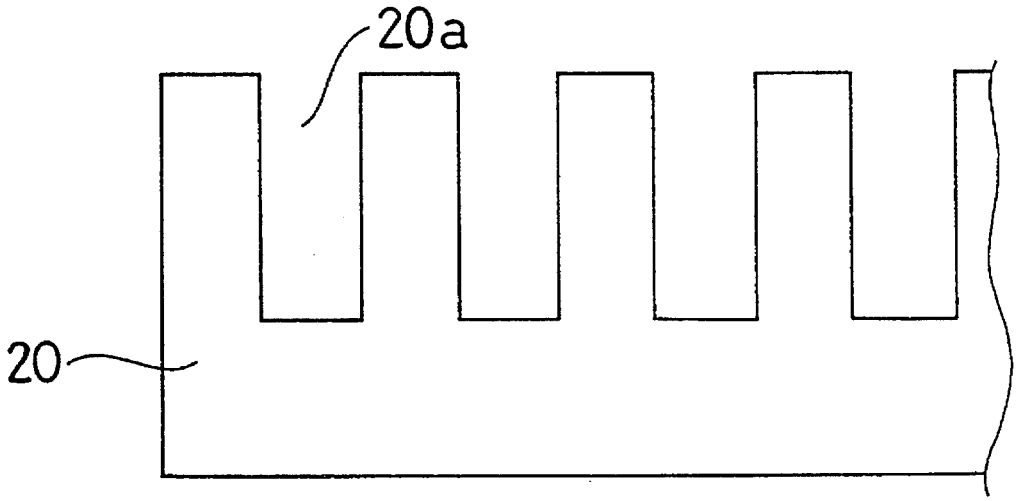
FIG. 12 is an enlarged front view showing a modification of the auxiliary guide member.

FIG. 12 shows a modification of the auxiliary guide member 20. The auxiliary guide member 20 shown in this figure is formed to be comb-shaped where a plurality of cuts 20*a* are provided in a direction perpendicular to the conveying direction of the transfer sheet S, i.e. along the width of the transfer sheet S. The structure of other portions thereof is the same as that of the first embodiment.

In the case of the comb-shaped auxiliary guide member 20, since the elasticity can be adjusted without any hindrance in the supporting ability for the transfer sheet S by forming the cuts 20*a* of appropriate area and configuration, an auxiliary guide member with the most suitable elasticity can be produced.

While a rotating photoreceptor drum is used as an electrostatic latent image carrier in the above-described embodiments, the present invention may be employed for an arrangement where an endless belt type photoreceptor which circularly moves is used. Moreover, as the charge supplying means, a member which is fixed at a position opposite to the drum may be used instead of a rotating transfer roller.

As described above, according to the present invention, since a guide member, an auxiliary guide member and a conveying roller are arranged on the sheet conveying path in an image forming apparatus where a charge supplying means is arranged so as to be out of contact with the surface of an electrostatic latent image carrier, it is prevented that the toner located in a central portion of the drum surface is not transferred onto the transfer sheet S and that toner scatters and adheres to a peripheral portion of the image transferred onto the transfer sheet S, and a high-definition image is obtained as far as the rear end of the transfer sheet S.

Obviously, many modifications and variations of the present invention are possible in light of the above teachings. It is therefore to be understood that within the scope of the appended claims, the invention may be practiced other than as specifically described.

What is claimed is:

1. An image forming apparatus comprising:

an image carrier for carrying an image formed by charged toner on a surface thereof;

a charge supplier charged to a polarity reverse to a polarity of the charged toner on the surface of the image carrier, said charge supplier being arranged opposite to the image carrier so that a gap larger than a thickness of a sheet of paper onto which the image is transferred exists between the charge supplier and the image carrier;

a guide member for guiding the sheet of paper in a direction such that the sheet of paper abuts the image carrier at a predetermined angle, said guide member being arranged so that an end thereof is close to the surface of the image carrier; and an auxiliary guide member arranged on a sheet conveying path between the end of the guide member and the image carrier.

2. An image forming apparatus according to claim 1, wherein said auxiliary guide member is made of a sheet member having an elasticity.

3. An image forming apparatus according to claim 1, wherein said auxiliary guide member is made of a comb-shaped sheet member having an elasticity, said comb-shaped sheet member being provided with a plurality of cuts in a direction perpendicular to a conveying direction of the sheet of paper.

4. An image forming apparatus comprising:

an image carrier for carrying an image formed by charged toner on a surface thereof;

a charge supplier charged to a polarity reverse to a polarity of the charged toner on the surface of the image carrier, said charge supplier being arranged opposite to the image carrier so that a gap larger than a thickness of a sheet of paper onto which the image is transferred exists between the charge supplier and the image carrier;

a resist roller pair for conveying the sheet of paper toward the image carrier;

a guide member for guiding the sheet of paper conveyed by the resist roller pair in a direction such that the sheet of paper abuts the image carrier at a predetermined angle, said guide member being arranged so that an end thereof is close to the surface of the image carrier;

an auxiliary guide member arranged on a sheet conveying path between the end of the guide member and the image carrier; and a conveying roller rotated at a peripheral speed equal to a movement speed of the surface of the image carrier, said conveying roller being arranged in a vicinity of the end of the guide member to be opposite to the guide member so that the sheet of paper passes between the conveying roller and the guide member.

5. An image forming apparatus according to claim 4, wherein said conveying roller is arranged so that a predetermined gap exists between the conveying roller and the guide member.

* * * * *

UNITED STATES PATENT AND TRADEMARK OFFICE

CERTIFICATE OF CORRECTION

PATENT NO. : 5,453,823
DATED : September 26, 1995
INVENTOR(S) : Masahiro HASHIZUME ET AL.

It is certified that error appears in the above-indentified patent and that said Letters Patent is hereby corrected as shown below:

On the title page, change item

"[*] Notice: The portion of the term of this patent subsequent to Aug. 9, 2011 has been disclaimed."

to

--[*] Notice: The term of this patent shall not extend beyond the expiration date of Pat. No. 5,337,128.--.

Signed and Sealed this

Seventeenth Day of September, 1996

*Attest:*

*Attesting Officer*

BRUCE LEHMAN

*Commissioner of Patents and Trademarks*